US005120598A

United States Patent [19]

Robeson et al.

[11] Patent Number: 5,120,598

[45] Date of Patent: Jun. 9, 1992

[54] FIBROUS MATERIAL FOR OIL SPILL CLEAN-UP

[75] Inventors: Lloyd M. Robeson, Macungie; Robert J. Axelrod, Orefield; Thomas A. Manuel, Allentown, all of Pa.

[73] Assignee: Air Products and Chemicals, Inc., Allentown, Pa.

[21] Appl. No.: 739,563

[22] Filed: Aug. 2, 1991

Related U.S. Application Data

[63] Continuation-in-part of Ser. No. 682,168, Apr. 5, 1991.

[51] Int. Cl.[5] ..... D04H 1/58

[52] U.S. Cl. ..... 428/288; 428/224; 428/903; 428/903.3; 428/910

[58] Field of Search ..... 428/224, 903, 910, 903.3, 428/288

[56] References Cited

U.S. PATENT DOCUMENTS

| | | | |
|---|---|---|---|
| 3,097,991 | 7/1963 | Miller et al. | 162/157 |
| 3,099,067 | 7/1963 | Merriam et al. | 28/82 |
| 3,382,305 | 5/1968 | Breen | 264/171 |
| 4,877,682 | 10/1989 | Sauers et al. | 428/903.3 |

FOREIGN PATENT DOCUMENTS

| | | |
|---|---|---|
| 40-72398 | 11/1965 | Japan . |
| 47-67754 | 7/1972 | Japan . |
| 1206257 | 9/1970 | United Kingdom . |

OTHER PUBLICATIONS

K. C. Stueben & W. Sommer, Polysulfone Papers from Immiscible Polymer Mixtures, Jan. 1978, pp. 85-87.

*Primary Examiner*—James J. Bell

*Attorney, Agent, or Firm*—Robert J. Wolfe; James C. Simmons; William F. Marsh

[57] ABSTRACT

A novel product is disclosed for cleaning up oil spills. The product comprises ultra-fine polymeric fibers which are produced from various polymeric materials by mixing with thermoplastic poly(vinyl alcohol) and extruding the mixture through a die followed by further orientation. The poly(vinyl alcohol) is extracted to yield liberated ultra-fine polymeric fibers. The fibers are ultimately processed into said product, such as a mat which is placed directly on the oil spill to absorb the oil.

12 Claims, No Drawings

FIBROUS MATERIAL FOR OIL SPILL CLEAN-UP

CROSS-REFERENCE TO RELATED APPLICATION

This application is a continuation-in-part of U.S. application Ser. No. 07/682,168, filed Apr. 5, 1991, now pending.

FIELD OF THE INVENTION

The invention relates to an oil spill clean-up product and a process for making the same from various polymeric materials.

BACKGROUND OF THE INVENTION

The problem of oil and related petroleum based spills on the world's waterways is becoming an increasing problem. New and improved concepts are sought to allow for resolution of the environmental problem. One approach is the use of hydrophobic fine fibers to soak up the oil from the water surface and contain it for removal. In fact, hydrophobic fine fibers made from polypropylene were employed in the Exxon Valdez oil spill.

Various processes exist for conversion of polymeric materials, such as polypropylene, into fine fibers. The polypropylene fibers employed in the Exxon Valdez spill were made by a melt blown process. Other processes included melt spinning technology and polymer blend processes followed by extraction of one of the polymer components.

Miller and Merriam note in U.S. Pat. No. 3,097,991 that a polymer pulp can be made by extrusion of immiscible polymers followed by a paper beating type operation to separate the immiscible fibers. These fibers could then be dispersed in water to form the polymer pulp. The use of a solvent for one of the constituents of the immiscible polymer blend to liberate the fibers was noted in a similar patent by Miller and Merriam (U.S. Pat. No. 3,099,067). This patent discussed methods to make ultra-fine fibers of polyethylene, polychlorotrifluoroethylene, or polyamides. U.S. Pat. No. 3,382,305 discloses a process for the formation of oriented materials containing microfibers by blending at least two incompatible fiber-forming polymers via extrusion followed by drawing (orienting) and optionally dissolving one of the polymers from the resultant fibrous material. None of these references disclose the potential use of the fibers for oil clean-up or the utility of poly(vinyl alcohol) as a water soluble matrix for the production of the fibers.

Several Japanese patent references do mention the utility of fine fiber production using poly(vinyl alcohol) but do not extract the poly(vinyl alcohol) from the fibers. Japanese Patent Application Showa 47-67754 discloses the use of polymer mixtures incorporated into poly(vinyl alcohol) by extrusion followed by optional drawing and beating in water containing an inorganic salt to prevent poly(vinyl alcohol) solution. The resultant product was noted to be useful for paper, non-woven textiles, and can be mixed with cellulosic pulp fiberils.

Japanese Patent Application Showa 44-20869 discloses that molded articles can be formed from a water-containing poly(vinyl alcohol) and a thermoplastic polymer. This patent notes that water can be added to poly(vinyl alcohol) to render it thermoplastic. The amount of water added is 25 to 60% by weight of the poly(vinyl alcohol). Formation of fibers via poly(vinyl alcohol) extraction is not noted.

British Patent 1,206,257 discusses a blend of poly(vinyl alcohol) with polyolefins. The poly(vinyl alcohol) is plasticized to allow for thermoplastic behavior. One example (example 9) notes that fibrous webs may be produced. Again, however, extraction of the poly(vinyl alcohol) was not discussed nor was the use of these fibers for oil clean-up.

Polysulfone papers have been made by Stueben and Sommer (TAPPI, 61(1), 85 (1978) by blending polysulfone and a partially neutralized ethylene-acrylic acid copolymer followed by extrusion and cold drawing of a monofilament. Mechanical beating of the monofilament and extraction of the ethylene copolymer in a hot alkaline solution yielded polysulfone pulp which could be formed into webs using conventional paper making equipment. Various other polymer blends were discussed but did not give adequate products via this process. Poly(vinyl alcohol) was not discussed.

A unique application was proposed by Byck et. al. (Polymeric Materials for Circulatory Asst Devices Artificial Heart Program Conference Proceedings, (R J. Hegyeli, ed.) p. 123, U.S. Printing Office, Washington, D.C., 1969) using a blend of polypropylene and a partially neutralized ethylene-acrylic acid copolymer The blend was extruded into a thin tape followed by orientation. When placed in a hot alkaline bath, the tape was pulled transverse to the machine direction (orientation direction) of the tape. The ethylene copolymer was extracted leaving a fine fiber web with dimensions between the fibers similar to cell dimensions. Using cell cultures from the interior of blood vessels, a cell growth could anchor on the web and present a blood compatible surface. The use of poly(vinyl alcohol) for this operation was not noted.

SUMMARY OF THE INVENTION

The present invention is an oil spill clean-up product comprising a thermoplastic polymeric material which is immiscible with thermoplastic poly(vinyl alcohol). The process for forming the oil spill clean-up product comprises the following steps:

(a) mixing the thermoplastic polymeric material with thermoplastic poly(vinyl alcohol);
(b) extruding the resultant mixture through a die;
(c) subjecting the mixture to an orientation step;
(d) chopping the extruded oriented material into the desired lengths;
(e) extracting the thermoplastic poly(vinyl alcohol to produce ultra-fine polymeric fibers; and
(f) processing the ultra-fine polymeric fibers into said oil spill clean-up product.

Thermoplastic poly(vinyl alcohol) uniquely fits the requirements for the extractable polymer in the above process. These requirements include the following:

1. high water solubility
2. thermoplasticity above 170° C.
3. immiscibility with a wide range of polymers
4. capable of being highly oriented
5. biodegradable

DETAILED DESCRIPTION OF THE INVENTION

The present invention is an oil spill clean-up product comprising ultra-fine polymeric fibers which exhibit high oil absorption performance. In addition to cleaning ıp oil spills on waterways, the present invention can be ıpplied to virtually any petroleum based spill such as hose found in service stations and machine shops. The ype of product the fibers are ultimately processed into lepends on the particular application. For most applica- ions, the fibers can be pulped into a mat using conven- ional papermaking equipment. The mat is then placed lirectly on the oil spill to absorb the oil.

The process contemplated for production of the ul- ra-fine fibers which comprise the present invention nvolves the extrusion of a mixture of a thermoplastic oly(vinyl alcohol) and the desired polymer (or poly- ners). Prior to being mixed with the thermoplastic oly(vinyl alcohol), the thermoplastic polymeric mate- ial may be ground, if not already in granular form, ypically by mechanical or cryogenic grinding tech- iques, to form granular flakes. The desired profile for he extrusion mixture is a monofilament, however, cast riented films, blown films, and extruded tapes may also e considered. After extrusion, the resultant strand is riented (either hot drawn or cold drawn or both). Orientation is desired but is not always necessary. By roper design of the extrusion die to allow for stream- ine flow, sufficient orientation in the die will allow for ibrous structures to be formed. This is the case where oor drawability of the poly(vinyl alcohol)/polymer nixture results such as is sometimes the case for post consumer polymer scrap. Following orientation, the esultant oriented strand is chopped into small particles f the desired length. The particles are then agitated in water to extract the thermoplastic poly(vinyl alcohol) nd filtered and dried.

Thermoplastic poly(vinyl alcohol) uniquely fits the equirements for a desired extractable matrix polymer or the production of ultra-fine fibers of the present nvention. These requirements include the following:

1. The polymer matrix must be water soluble (preferred both cold water solubility and hot water solubility).
2. The solubilization of the matrix polymer by water should be rapid.
3. The polymer matrix should be thermoplastic in the range of 170° C.-230° C. and above. This will allow for processing of the various thermoplastic polymeric materials which are of interest for the composition of the present invention.
4. The polymer matrix must be immiscible with the polymeric material.
5. The polymer matrix must be capable of being highly oriented and it must maintain that ability with large amounts of added polymeric material.
6. The polymer matrix is desired to be biodegradable. Even if recovery of the polymer matrix is contemplated, total recycle is not possible and waste pond biodegradation will be thus desired and possibly required.

The polymers contemplated for the ultra-fine fibers for this invention are desired to be hydrophobic so that il pick-up will be possible. Generally, the desired poly- ners will be in the polyolefin family. Polypropylene, igh density polyethylene, low density polyethylene, inear low density polyethylene, very low density linear olyethylene, ethylene-propylene rubber, ethylene co- olymers such as ethylene-vinyl acetate, ethylene-ethyl ıcrylate, ethylene-methyl acrylate, ethylene-acrylic ıcid, and isomers, ethylene-methacrylic acid and iono- ners and the like comprise these systems. Polystyrene, tyrene/acrylonitrile copolymers, ABS, poly(vinyl chloride), poly(vinyl acetate), polyphenylene oxide-polystyrene blends are additional systems of interest. Blends of the above constituents are also of interest and indeed offer an advantage in yielding lower diameters than achievable with the unblended polymers. Additionally, post consumer polymer scrap is of interest for the oil pick-up application discussed herein.

The poly(vinyl alcohol) utilized in this invention is prepared from the hydrolysis of poly(vinyl acetate). The preparation of poly(vinyl acetate) and hydrolysis to poly(vinyl alcohol) are discussed in detail in the books "Poly(vinyl alcohol): Properties and Applications," ed. by C. A. Finch, John Wiley & Sons, New York, 1973 and "Poly(vinyl alcohol) Fibers," ed. by I. Sakurada, Marcel Dekker, Inc., New York, 1985. A recent review of poly(vinyl alcohol) was given by F. L. Marten in the Encyclopedia of Polymer Science and Engineering, 2nd ed. Vol. 17, p. 167, John Wiley & Sons, New York, 1989. As noted in this reference, several patents claim the preparation of extrudable poly(vinyl alcohol) utilizing high boiling water soluble organic compounds containing hydroxyl groups. These compounds (e.g. glycerol, low molecular weight poly(ethylene glycols) are plasticizers which lower the melting point of poly(vinyl alcohol) into a processible range. Other suitable plasticizers such as sulfonamides can be considered if they are high boiling, water soluble and miscible with poly(vinyl alcohol).

A thermoplastic poly(vinyl alcohol) is required for this invention and the above noted plasticizers are incorporated to achieve thermoplastic behavior. Other water soluble polymers can also be added such as poly(vinyl pyrrolidone), poly(ethyloxazoline) and poly(ethylene oxide). The range of hydrolysis of poly(vinyl alcohol) useful for this invention is between 72 and 99% with the preferred range being 78 to 94%. The composition range of the thermoplastic poly(vinyl alcohol) in the poly(vinyl alcohol)/polymeric material mixture is between 20 to 80% by weight. At the lower range, lower viscosity compositions of poly(vinyl alcohol) are desired in order to allow for fibers to be formed. This is the result of the melt morphology which requires some continuous phase morphology of the poly(vinyl alcohol) if extraction of the poly(vinyl alcohol) is to be complete and fibrous structure of the water immiscible polymer is to occur. This is well known in the art as the lower viscosity phase tends to be the continuous phase at equal by weight compositions, and at lower compositions continuity can be maintained by increasing the viscosity mismatch between the phases such that the phase desired to be continuous has a much lower viscosity than the other polymer constituent.

The extrusion of the blend of this invention can be conducted in conventional polymeric extrusion equipment. The die should be designed to optimize orientation to yield streamline flow prior to die exit. The take-up equipment is preferably designed to further orient the extruded strand. Hot drawing or cold drawing using conventional fiber spinning equipment is contemplated. Cold-drawing of the extruded strand is desired where improved strength and modulus of the fine-fibers produced via this process are desired. A melt-blow fiber forming process is also possible for this invention to yield ultra-fine fibers produced after poly(vinyl alcohol) extraction. The extruded strand can be cooled in air, on a chilled belt, on dry ice, or even cooled via extrusion into a water bath. If a water bath is employed, replacement of the water to prevent poly(vinyl alcohol) concentration in the water bath is desired. The use of a water bath will allow for the initiation of the extraction process and the resultant chopped pellets should be directly fed to a water medium for agitation and poly(-vinyl alcohol) extraction to prevent blocking of the pellets due to water devolatilization.

The extrusion of the thermoplastic poly(vinyl alcohol) and various polymers into cylindrical structures through a circular die is a preferred embodiment of this invention. Other geometries include slot dies and film dies to yield tapes and films which are also oriented via hot drawing or cold drawing procedures. The resultant oriented structures can be chopped into convenient lengths. The resultant pellets, chopped tapes or films can be added to water and optionally allowed to soak in water (cold or hot) and then added to a device to provide shear to separate the fine fibers from the poly(vinyl alcohol). This equipment can include various blenders equipped with agitation devices including those commonly utilized in the pulp and paper industry to beat wood particles into pulp. The foaming which results can be controlled by the addition of an antifoam for poly(vinylalcohol) known in the art and also described in U.S. Pat. Nos. 4,844,709 and 4,845,140. The addition of antifoam is however not necessary if closed vessels are employed for the agitation of the poly(vinyl alcohol) fine fiber composite. Indeed, the foaming may yield improved liberation of the fibers. The resultant agitated blend consisting of liberated fibers and extracted poly(-vinyl alcohol) dissolved in the water phase can be separated via filtration using porous mesh screens or other appropriate filtration media. The extraction process can be repeated (with optionally further agitation) to remove substantially all of the poly(vinyl alcohol). This process can be repeated several times depending on the level of poly(vinyl alcohol) removal desired. In some cases, minor amounts of residual poly(vinyl alcohol) may be desired in order to yield specific characteristics (e.g. wettability, pulpability) to the product. The extracted poly(vinyl alcohol) can be recovered, dried and recycled in this process. Countercurrent extraction processes are contemplated utilizing water fed to the last extraction stage and recovered and utilized in the other stages. The most concentrated poly(vinyl alcohol) extract will come from the first stage which can then be recovered for reuse in this process or recovered for utilization in other poly(vinyl alcohol) applications. The resultant extracted fibers can be dried and utilized in the application contemplated by the present invention. The use of thermoplastic poly(vinyl alcohol) to form mocrofibers and, unlike the prior art, subsequently extracting the poly(vinyl alcohol) from the formed fibers, allows the present process to produce useful fibers from various polymers including heterogeneous scrap material, even in the presence of non-thermoplastic contaminants, such as paper residue.

Another advantage of using thermoplastic poly(vinyl alcohol) is, as stated above, that it is biodegradeable and therefore does not present a serious environmental problem relating to disposal in a waste stream. Notwithstanding this fact, it has been found that the extracted poly(vinyl alcohol) can be recycled and reused in the original mixing step with additional scrap material, thus reducing cost and waste and increasing process efficiency.

While the preferred embodiment of the present invention utilizes strands (monofilaments) which have been pulped into a mat, alternate embodiments include extruded sheet or film which, following orientation and extraction of the poly(vinyl alcohol), is applied directly to the oil contaminated water. It is also possible to apply the unextracted sheet or film to the oil contaminated water. The poly(vinyl alcohol) would be extracted by the water leaving a web for oil pick-up. Another option would be to contain the microfibers produced in this invention between porous mesh screens or porous mesh cylinders so that the oil picked up by the microfibers can be easily collected.

The examples set forth below are presented to illustrate the process of making the fibers which comprise the present invention and are not intended to be limiting.

EXAMPLE 1

A mixture of 55% thermoplastic poly(vinyl alcohol) (Vinex 2025) and 45% polypropylene (Profax 6523 Himont) was extruded in a Killion 1" single screw extruder (L/D=24/1) at 200° C.. The extruder RRM was 36, the product rate was 5.3 lbs/hour and the strand rate (2 strands) was 17 ft/minute after drawing. The sample was hot drawn and cooled on steel rollers prior to pelletizing. The pellets were immersed in warm water for several minutes followed by agitation in a laboratory blender. The sample was then filtered using cheesecloth and resoaked in water followed by agitation. This process was repeated four times to remove the residual poly(vinyl alcohol). The fine fibers were then dried. The photomicrographs taken with SEM (scanning electron microscope) indicated fiber diameters in the range of 1 to 10 m.

EXAMPLE 2

The fibers of example 1 were immersed in water and mixed in a pulp disintegrator. The resultant slurry was formed into mats using the British Standard handsheet former following TAPPI Method 205. The synthetic pulp mats were then removed and dried.

EXAMPLE 3

The mats of example 2 after drying were subjected to oil sorption tests. The oil sorption test consisted of preweighed fiber mat being immersed in a pan of Sunoco Ultra 10W30 motor oil and allowed the sheet to soak for various time intervals. The sheet was then transferred to a dry pan and weighed. For the ultra-fine fiber sample of example 1 sheets of various weights were prepared as per the procedure of example 2. The oil sorption results are given in Table 1.

TABLE 1

| Weight of Fiber Mat | Oil Sorption (%) | | | |
|---|---|---|---|---|
| (grams) | 10 min. | 20 min. | 30 min. | 40 min |
| 1.8909 | 1,906% | 1,968% | — | — |
| 3.7266 | 346% | 1,945% | 1,956% | — |
| 6.7659 | 1,245% | 1,406% | 1,504% | 1,507% |

EXAMPLE 4

A sample of NJCT (New Jersey Curbside Tailings) was obtained (Plastics Engineering, p. 33, Feb. 1990). The sample was washed, extruded and cryoground. A blend of 45% Vinex 2034 thermoplastic poly(vinyl alcohol), 45% cryoground NJCT and 10% Surlyn 9020 (ethylene-methacrylic acid ionomer:duPont) was extruded at 180°-190° C. hot drawn, cooled and pelletized. The pellets were water extracted as per the proce dure noted in example 1. The dried fine fibers of this example were formed into mats using the procedure of example 2. The oil sorption results on these mats as per the sorption procedure noted in Example 3 are listed in Table 2.

TABLE 2

| Weight of Fiber Mat (grams) | Oil Sorption (%) | | |
|---|---|---|---|
| | 10 min. | 20 min. | 30 min. |
| 1.9397 | 895% | 895% | — |
| 4.2119 | 585% | 638% | 713% |
| 5.8040 | 486% | 495% | 534% |

EXAMPLE 5

A sample of NJCT (as described in example 4) was washed in water and the granules which floated were separated and dried. This sample was blended with Vinex 2025 thermoplastic poly(vinyl alcohol) 50/50 by wt., extruded in a 1" single screw Killion extruder (L/D=30/1), hot drawn, cooled over dry ice, and pelletized. The pellets were extracted of the poly(vinyl alcohol) as per the procedure of example 1 and ultrafine fibers resulted. The fibers were formed into mats as per the procedure in example 2. Nominally, 2, 4 and 6 gr. mats were prepared for oil sorption studies as per example 3. The oil sorption results are given in Table 3.

EXAMPLE 6

A blend of 50% Vinex 2025/40% Profax 6823 polypropylene/10% Surlyn 8660 (ethylene-methacrylic acid ionomer:duPont) was extruded using a 1" Killion extruder equipped with mixing sections (L/D=30/1) at 180°-190° C. The extruded strand was hot drawn (10/1 draw ratio) cooled and pelletized. The extruder RPM was 8.0 and the product rate was 800 grams/hr. The resultant product was extracted with water to remove the poly(vinyl alcohol) and liberate the fibers as per the procedure in example 1. The fibers were formed into mats as per the procedure in example 2. Nominally, 2,4, and 6 gr. mats were prepared for oil sorption studies as per example 3. The oil sorption results are given in Table 3.

EXAMPLE 7

A blend of 50% Vinex 2025/30% Profax 6823/20% Surlyn 8660 was extruded using a Killion 1" single-screw extruder equipped with Maddox mixing elements (L/D=30/1) at 180°-190° C. The extruded strand was hot drawn (12/1 draw ratio) cooled and pelletized. The extruder RPM was 9.0, and the product rate was 732 grams/hours.

The resultant product was extracted with water to remove the poly(vinyl alcohol) and liberate the fibers as per the procedure in example 1. The fibers were formed into mats as per the procedure in example 2. Nominally, 2, 4, and 6 gr. mats were prepared as per example 2 for oil sorption tests as per example 3. The oil sorption results are given in Table 3.

EXAMPLE 8

A blend of 55% Vinex 2025 and 45% polystyrene (Aldrich Chemical: 280,000 Mw) was extruded in a 1" Killion extruder (L/D=30/1) operating at 8.1 RPM at 180° C.-190° C. and a product extrusion rate of 1090 grams/hour. The extrudate was hot drawn at a 12/1 draw ratio, cooled and pelletized. The resultant product was extracted with water to remove the poly(vinyl alcohol) and liberate the fibers as per the procedure in example 1. The fibers were formed into mats as per the procedure in example 2. Nominally, 2, 4 and 6 gram mats were prepared as per example 2 for oil sorption tests as per example 3. The oil sorption results are given in Table 3. SEM photomicrographs indicate the diameters to be primarily in range of 0.5 to 1.0m.

EXAMPLE 9

A blend of 55% Vinex 2025, 22.5% Profax 6523 polypropylene and 22.5% polystyrene (same as example 8) was extruded in a 1" Killion extruder at 180°-190° C. operating at 8.1 RPM and a product rate of 800-900 grams/hours. The extrudate was hot drawn at a 12/1 draw ratio, cooled and pelletized. The resultant product was extruded with water to remove the poly(vinyl alcohol) and liberate the fibers as per the procedure in example 1. The fibers were formed into mats as per the procedure in example 2. Nominally, 2, 4, and 6 gram mats were prepared as per example 2 for oil sorption tests as per example 3. The oil sorption results ar given in Table 3.

CONTROL EXAMPLE

A fine fiber sample of Pulpex EDH was obtained from Hercules for evaluation. Pulpex EDH is a polyethylene fine fiber produced specifically for sprayed ceiling texture compounds. The properties are: density=0.96 g/cc; melting point=132° C., fiber length 0.6-1.2 mm, fiber diameter=30-40 m. Pulpex EDH was agitated into a pulp-like consistincy and mats were prepared as per the procedure noted in example 2 and tested for oil sorption as per the procedure in example 3. The oil sorption results on nominal 2 gr, 4 gr and 6 gr sheets are listed in Table 3.

EXAMPLE 10

A mixture of 50% thermoplastic poly(vinyl alcohol) (Vinex 2025) and 50% polypropylene Profax 6523 was extruded in a 1" Killion single screw (L/D=30/1) extruder at 180°-190° C., hot drawn, and pelletized. The pellets were agitated in water followed by several extractions and drying. Mats were prepared as per the procedure noted in example 2 and tested for oil sorption as per the procedure noted in example 3. The oil sorption results on approximate 2 gr, 4 gr and 6 gr sheets are listed in Table 3.

TABLE 3

Comparison of Oil Sorption Results

| Sample Designation | Oil Sorption (weight % increase) (>20 minutes immersion) | | |
|---|---|---|---|
| | 2 gr | 4 gr | 6 gr |
| Control Example | 998% | 811% | 743% |
| Example 5 | 1,293% | 1,014% | 900% |
| Example 6 | 1,076% | 751% | 675% |
| Example 7 | 880% | 620% | 734% |
| Example 8 | 1,233% | 696% | 590% |
| Example 9 | 1,068% | 708% | 546% |
| Example 10 | 1,593% | 1,725% | 1,330% |
| Example 1 | 1,968% | 1,956% | 1,506% |
| Example 4 | 895% | 713% | 534% |

Having thus described the present invention, what is now deemed appropriate for Letters Patent is set out in the following appended claims.

What is claimed is:

1. An oil spill clean-up product formed by a process comprising:

mixing thermoplastic polymeric material with thermoplastic poly(vinyl alcohol), extruding the resultant mixture through a die, followed by subjecting the mixture to an orientation step, chopping the extruded oriented material into desired lengths, extracting the thermoplastic poly(vinyl alcohol) to produce ultra-fine polymeric fibers, and thereafter processing the ultra-fine polymeric fibers into said oil spill clean-up product.

2. The oil spill clean-up product of claim 1 wherein said processing comprises pulping the ultra-fine polymeric fibers into a mat.

3. The oil spill clean-up product of claim 1 wherein said thermoplastic polymeric material is selected from the group consisting of polypropylene, polyethylene, polystyrene, styrene copolymers, poly(vinyl chloride), ethylene copolymers and mixtures thereof.

4. The oil spill clean-up product of claim 1 wherein said thermoplastic polymeric material is post-consumer polymeric scrap.

5. The oil spill clean-up product of claim 1 wherein a defoaming agent is added to the polymeric material/-poly(vinyl alcohol) mixtures.

6. The oil spill clean-up product of claim 1 wherein the poly(vinyl alcohol) is extracted from the polymeric fibers by agitation in a water slurry.

7. The oil spill clean-up product of claim 1 wherein the extracted poly(vinyl alcohol) is recycled and reused in this process.

8. The oil spill clean-up product of claim 1 wherein the thermoplastic poly(vinyl alcohol) is formed by adding a plasticizer to poly(vinyl alcohol).

9. The oil spill clean-up product of claim 8 wherein said plasticizer is glycerine.

10. The oil spill clean-up product of claim 1 wherein said thermoplastic poly(vinyl alcohol) is from 72–99% hydrolyzed.

11. The oil spill clean-up product of claim 1 wherein said thermoplastic poly(vinyl alcohol) is from 78–94% hydrolyzed.

12. The oil spill clean-up product of claim 1 wherein the mixture resulting from said mixing of thermoplastic polymeric material with thermoplastic poly(vinyl alcohol) contains between 20% and 80% thermoplastic poly(vinyl alcohol) b weight.

* * * * *